United States Patent [19]

Li

[11] Patent Number: 4,536,356

[45] Date of Patent: Aug. 20, 1985

[54] CARBURETOR

[76] Inventor: Ching C. Li, 11231 Kingsbridge Dr., Richmond, British Columbia, Canada, V7A 4T1

[21] Appl. No.: 560,980

[22] Filed: Dec. 13, 1983

[51] Int. Cl.[3] ..... F02M 7/20

[52] U.S. Cl. ..... 261/50 R; 261/79 R; 261/142; 261/DIG. 82; 261/DIG. 74

[58] Field of Search ..... 261/DIG. 82, 50 R, 142, 261/79 R

[56] References Cited

U.S. PATENT DOCUMENTS

| | | | |
|---|---|---|---|
| 1,815,406 | 7/1931 | Hutchison | 261/79 R |
| 3,240,191 | 3/1966 | Wallis | 261/DIG. 82 |
| 3,782,639 | 1/1974 | Boltz et al. | 261/DIG. 82 |
| 3,915,137 | 10/1975 | Evans | 261/142 |
| 4,087,491 | 5/1978 | Chapin | 261/79 R |
| 4,311,126 | 1/1982 | Cowles | 261/DIG. 82 |
| 4,331,116 | 5/1982 | Simonds | 261/DIG. 82 |

FOREIGN PATENT DOCUMENTS

| | | | |
|---|---|---|---|
| 2034404 | 6/1980 | United Kingdom | 261/DIG. 82 |

*Primary Examiner*—Tim Miles

*Attorney, Agent, or Firm*—Fetherstonhaugh & Co.

[57] ABSTRACT

A carburetor for an internal combustion engine. The carburetor has an outer body defining a first venturi and having an inlet and an outlet. There is a first inner body located in the outer body and defining a second venturi and having an inlet and an outlet. A throttle valve controls air supply to the inlets of the inner and outer bodies. Air is agitated as it flows through the bodies. An injector nozzle is positioned to feed fuel to the second venturi. A valve controls fuel supply through the injector nozzle and sensor means determines movement of the valve. An idle jet feeds fuel to the second venturi downstream of the jet nozzle.

10 Claims, 12 Drawing Figures

CARBURETOR

FIELD OF THE INVENTION

This invention relates to a carburetor for an internal combustion engine.

DESCRIPTION OF THE PRIOR ART

The feeding of the proper amount of fuel to an internal combustion engine is, of course, essential to the proper operation of the engine. This is clearly true from a technical point of view but in recent times there is the additional complication that governments everywhere, particularly in the United States, are concerned about the amount of poisonous gases, particularly carbon monoxide and the oxides of nitrogen, issued from an internal combustion engine.

Thus a carburetor, or indeed any fuel feed system for an internal combustion engine, must satisfy a number of requirements. It must control the ratio of air to fuel for the proper running of the engine at the particular conditions under which the engine is running, whether it be high speed, low speed, high altitude or the like. Furthermore the carburetor must adequately mix the fuel and the air and, as far as possible, carry out the maximum possible vaporizing of the fuel and, thirdly, the carburetor must do the above, at least under modern conditions, in such a way that the minimum amount of pollution is caused.

Although there are carburetors that perform the first two functions well the necessity to perform the third function has proved difficult in carburation. Generally speaking the inability of the carburetor to carry out the third function has resulted in an increase in the popularity of fuel injection systems even though fuel injection is considerably more expensive than carburation because it is considerably more sophisticated.

The problem with a carburetor is that, at least generally stated, its operation is dependent upon the difference between ambient pressure and pressure within the cylinder of the internal combustion engine. However for most efficient operation far more factors should be considered. Engine operating conditions are affected by air density, air flow velocity, intake and exhaust gas temperature, humidity, intake air pressure differential and cooling system temperature. In addition the fuel itself must be considered. The volatility of the fuel, the specific gravity, the heat equivalent, the anti-detonation properties of the fuel must all be considered.

A way of correcting the deficiencies of the carburetor, particularly in regard to the emission of pollutants, have been to treat the exhaust gases either by recirculation or by catalytic degradation. However such additional treatment is expensive, increases the weight of the automobile and is generally unpopular with the motoring public.

Fuel injectors may be said to be more efficient than carburetors. Generally speaking a fuel injector pumps fuel either directly into the cylinder or, in less sophisticated systems, into the inlet manifold. Fuel injectors have become of increasing importance over the last 15 years. However a fuel injector is a high precision instrument and is particularly prone to blocking by dirty fuel. Furthermore the injectors are generally positioned too close to the intake or inlet valve in the cylinder. One effect of this is that the gasoline vapor has insufficient time to mix properly with the air prior to combustion. Thus although the fuel injection systems provide an excellent control of the air to fuel ratio they do not do so well in vaporizing the fuel nor in the mixing of the fuel with air. Furthermore the electrical system and additional parts of the fuel injection can be expensive to replace and difficult to repair.

SUMMARY OF THE INVENTION

Accordingly the present invention seeks to provide a combined system that has the best virtues of both carburetors and fuel injectors, in particular the relative cheapness, good mixing and good vaporization of the carburetor with the precise ratio control of fuel injector systems.

Accordingly, in the first aspect, the present invention is a carburetor for an internal combustion engine, the carburetor comprising an outer body defining a first venturi and having an inlet and an outlet; an inner body located in the outer body and defining a second venturi and having an inlet and an outlet; a throttle valve to control air supply to the inlets of the first and second bodies; means within the first and second bodies to agitate air flowing through the bodies; an injector nozzle positioned to feed fuel to the second venturi; a valve to control fuel supply through the injector nozzle; sensor means to determine movement of said valve; and an idle jet to feed a fuel to said second venturi downstream of the jet nozzle.

Desirably the inner body has openings adjacent the outlet end to allow air flow between the first and second bodies. Further a heating element may be provided to heat vapour leaving the inner body. The heating element may desirably be spring mounted to the inner body to facilitate mixing and heating of the vapour by minor vibration through the spring mounting.

BRIEF DESCRIPTION OF THE DRAWINGS

Aspects of the invention are illustrated, merely by way of example, in the accompanying drawings in which.

DESCRIPTION OF THE PREFERRED EMBODIMENT

Figure 1:
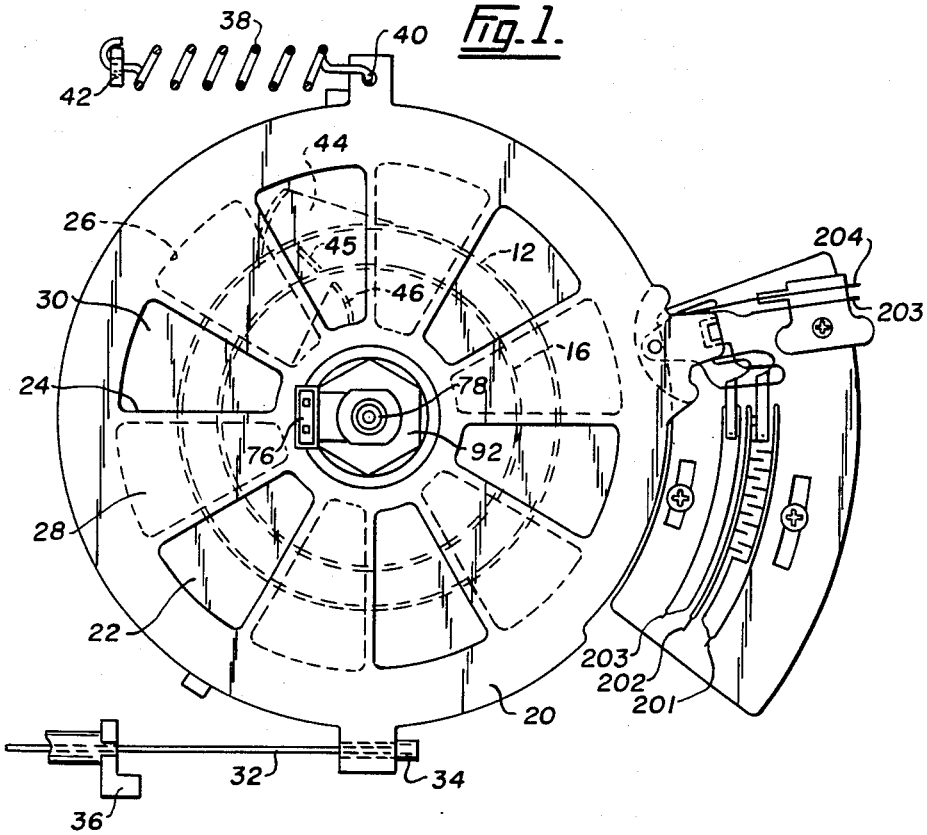
FIG. 1 is a plan view of a carburetor according to the present invention.

The drawings show a carburetor comprising an outer body 2 defining a first venturi 4 and having an inlet 6 and an outlet 8. The body 2 is provided with conventional mounting flanges 10 . There is a first inner body 12 located in the outer body and defining a second venturi 13 and also having an inlet 14 and an outlet 15. There is a second inner body 16 having a third venturi 17, an inlet 18 and outlet 19. A throttle valve controls the air supply to the inlets 6 and 14 of the first and second bodies 2 and 12. The throttle valve comprises an upper plate 20 and a lower plate 22 the two plates being relatively rotatable. Each plate is formed with open portions 24 and 26 and closed portions 28 and 30 as shown most clearly in FIG. 1 so that rotation of one or both the plates 20 and 22 controls the inlets 6, 14 and 18 of the bodies 2, 12 and 16. There is a throttle cable 32 attached to the upper plate 20 at 34 and located on an abutment 36, in conventional manner. Again as is conventional there is a throttle return spring 38 located at 40 and anchored at 42. The second inner body 16 is not essential to the invention but is preferred.

There are means within the bodies 2, 12 and 16 to agitate air flowing through the bodies. These means take the form of helically disposed walls 44, 45 and 46 positioned at the inner faces of the bodies 2, 12 and 16. The arrangement is such that air passing through the bodies is caused to swirl and thus to be agitated, greatly facilitating the ability of the air to absorb fuel vapour and, of course, to mix with that vapour. It should be noted that the wall 44 generally is spirally directed in the opposite direction to walls 45 and 46, the latter two being generally in contiguous pairs, see FIG. 1.

There is an injector nozzle 48 positioned to feed fuel to the second venturi 13, the venturi of the inner body 12. The injector nozzle 48 is relatively conventional and comprises a body 50 having an internal passageway 52 with an outlet 54. The body 50 has a circumferential depression 56 coinciding with the outlet 54. The body 50 is movable within second body 58. Second body 58 has a passageway 60 through which fuel may pass. The second body 58 has an inclined valve surface 62 to co-operate with a valve surface 64 on body 50 to prohibit the passage of fuel when the body 50 is moved down, that is in the position shown in FIGS. 2 and 3.

The injector nozzle 48 is solenoid operated. The solenoid has a coil 66 located in housing 68 and provided with a rubber seal 70. There is a spring 72 located on projection 74 on the upper end of the body 50. The arrangement is a conventional solenoid arrangement. Power for the operation of the solenoid is provided through terminal 76. An external fuel line (not shown) is attached at 78.

The injector nozzle is located by the provision of an internal thread 80 in a central boss 82 in lower plate 22. Housing 68 with external thread 84 engages in thread 80. The boss 82 abuts central portion 86 of upper plate 20. A washer 88 seals and locates by abutting shoulder 90. The washer permits rotation of plate 20. Housing 68 is closed by nut 92. The use of nut 92 permits access to coil 66. There is a cap 93 at the bottom of body 58, threadedly attached. A small channel 95 is defined between cap 93 and body 58.

There is an idle jet 94 to feed air to the second venturi 14 downstream of the nozzle 48. The idle jet 94 passes through the bodies 2, 12 and 16 and through gap 95 and is controllable by adjusting screw 96 in conventional manner.

Figure 2:
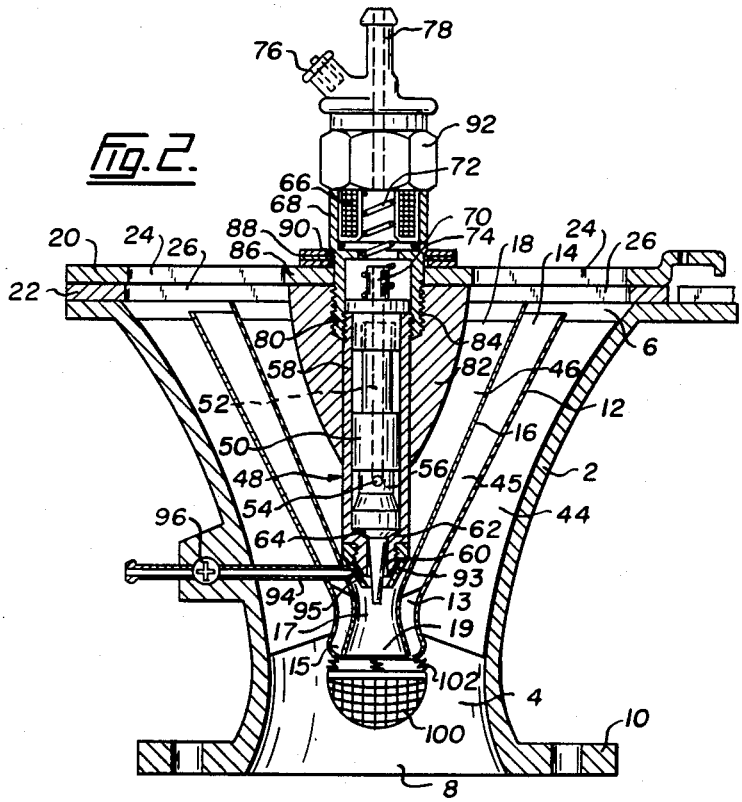
FIG. 2 is a section through the carburetor of FIG. 1.
Figure 3:
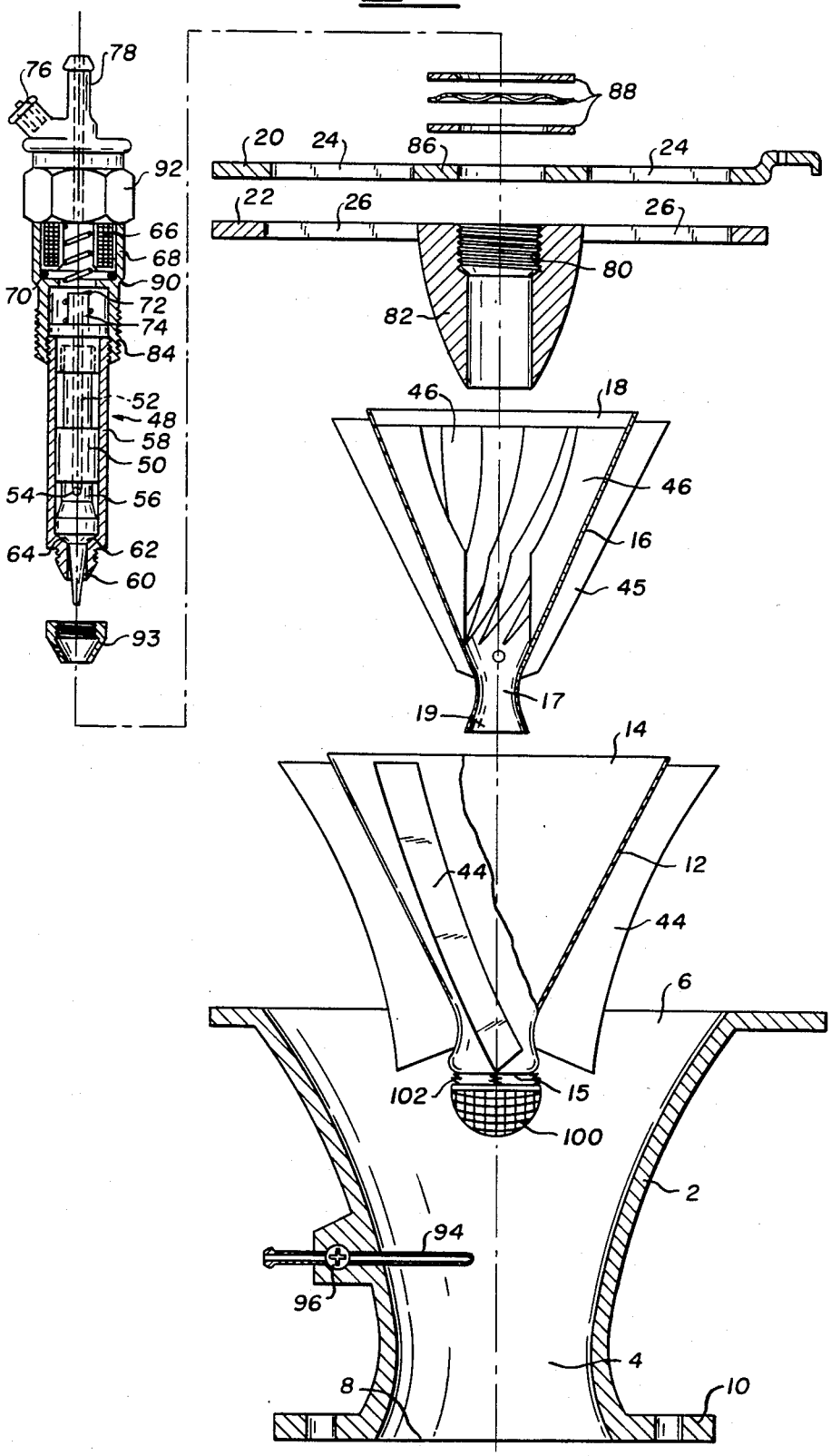
FIG. 3 is an exploded view of the carburetor according to the present invention.

Furthermore in the desirable embodiment of the invention illustrated in FIGS. 1 to 3 there is a heating element 100 that heats vapour leaving the outlets 15 and 19. The heating element 100 is mounted by springs 102 to the body 12 so that it may move within the rapidly moving gas currents within the carburetor to facilitate mixing of the fuel with the air.

Figure 4:
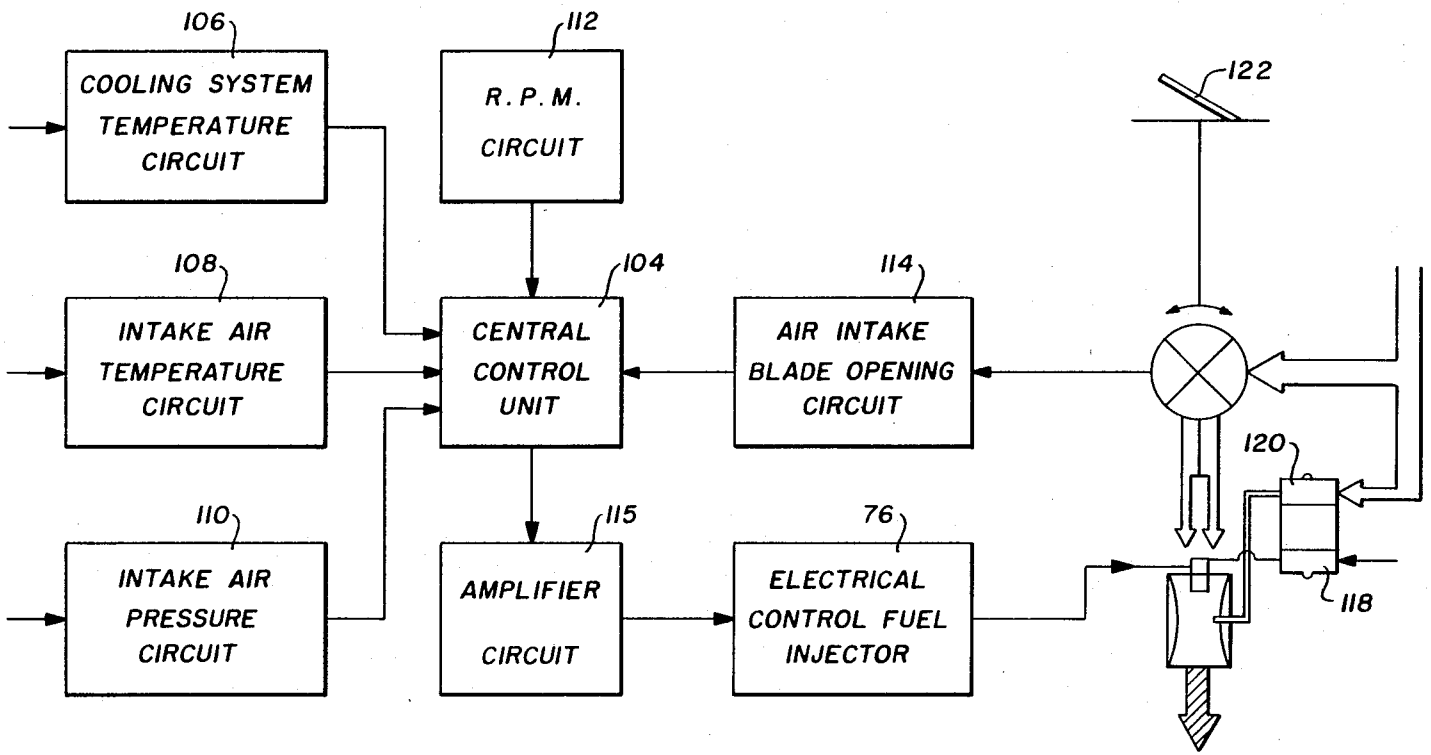
FIG. 4 illustrates the sensor means useful with the carburetor of the present invention.

FIG. 4 illustrates the control system or sensor means to facilitate operation of the carburetor according to the invention. The system comprises a number of sources of information feeding to a central control unit 104, which is an analog computer. All such components are known and will not be described in detail. The cooling system temperature is sensed by sensor 106 and the information fed to the central control unit 104. The control unit also receives information concerning the intake air temperature from sensor 108, the intake air pressure from sensor 110 and the revolutions per minute of the engine from sensor 112. Furthermore information concerning throttle opening, that is the relative positions of the plates 20 and 22 from sensor 114. The information is fed out, in conventional manner, through an amplifier circuit 115 to the electrical control of the fuel injector, that is the necessary current is sent to terminal 76. Air is provided through the air intake, including the idle air intake, and the necessary fuel is fed from a conventional fuel pump 118.

The result of this arrangement is that the variables that control the performance of an engine are continuously sensed and a signal thus provided at the central control unit. This signal is amplified and the necessary signal then sent to the fuel injector to regulate the fuel supply to the engine. Air supply for idle is provided by a pump 120 shown as the upper portion of the fuel pump 118.

Control from the driver's point of view is by a conventional throttle, for example gas pedal 122. Operation of the throttle causes the plate 20 to rotate. Air can then pass, depending on the depression of the throttle, through the openings 24 and 26 uncovered by movement of the plate 20.

Depending on the position of the throttle pedal an amount of fuel is fed to the engine. However mere control of the gas pedal is not sufficient. As indicated clearly in FIG. 4 the central control unit 104 also controls the fuel supply to ensure that for any particular mode of operation the engine, as determined by the position of the throttle pedal, the correct amount of fuel is provided for optimum efficiency and minimum pollution.

Figure 5:
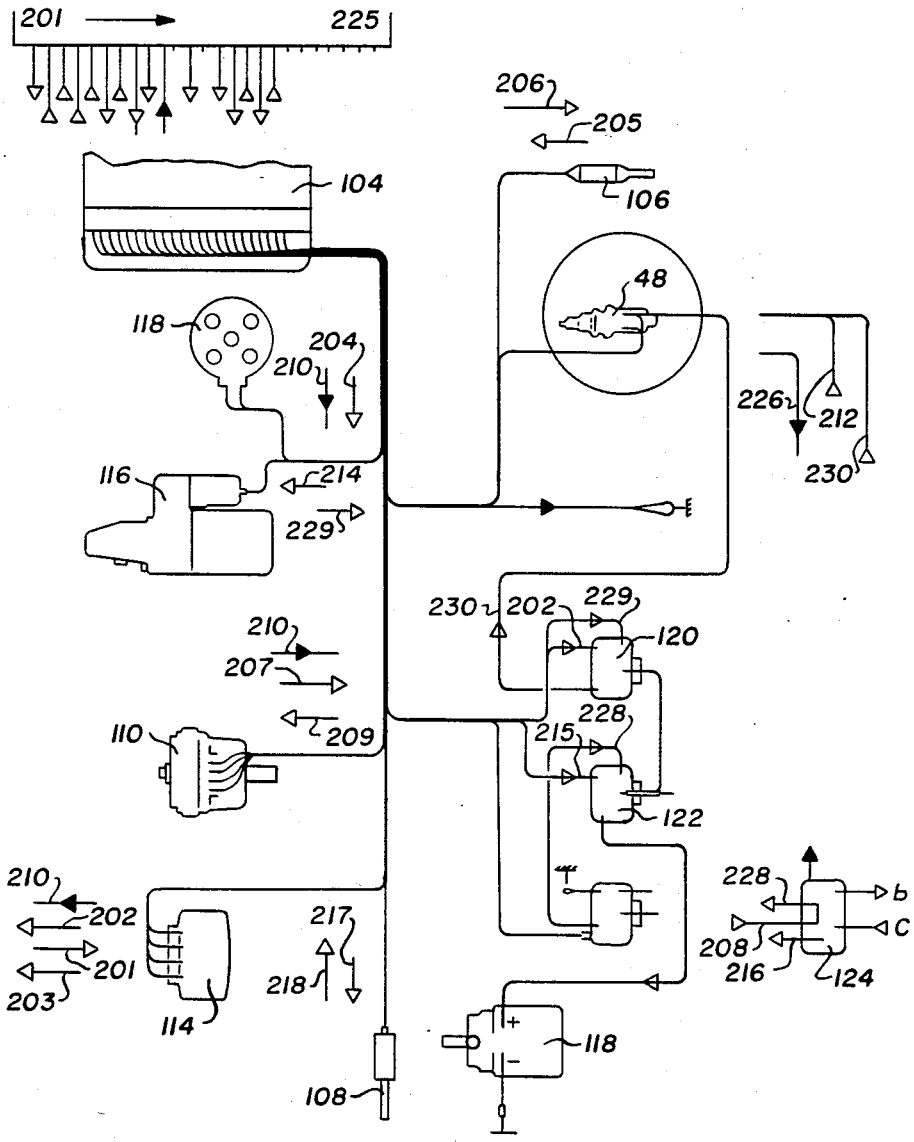
FIG. 5 illustrates the environment of the present invention in the engine of a vehicle.

In FIG. 5 the components as shown in previous drawings have the same reference numerals as in those previous drawings. In addition FIG. 5 shows a conventional starter motor 116 and distributor 118, the engine being a four cylinder. There is a cold start relay 120 a fuel pump relay 122 and a main relay 124. In FIG. 5 various signals, in the form of voltages, are shown by arrows thus the blade sensor 114 receives signals 201 and sends out signals 202 and 203. A constant voltage 208 is sent to the main relay 124.

The generation of the signals and the components that generate the signals will not be described in detail. All components are well-known, including the central control unit 104 which is, of course, a simple analog computer.

Figure 6A:
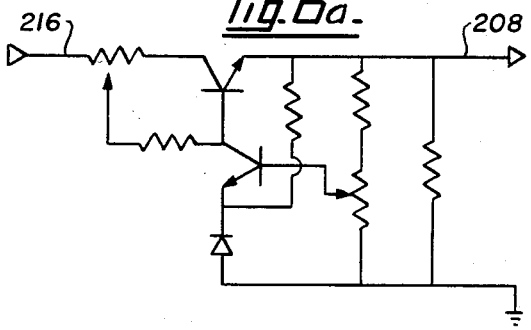
FIGS. 6*a* to 6*g* illustrate various circuits used.
Figure 6B:
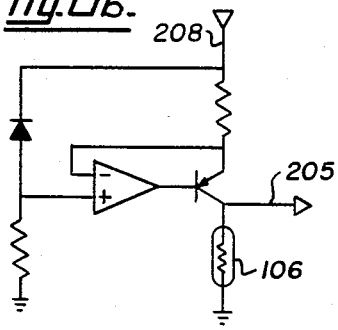
Figure 6C:
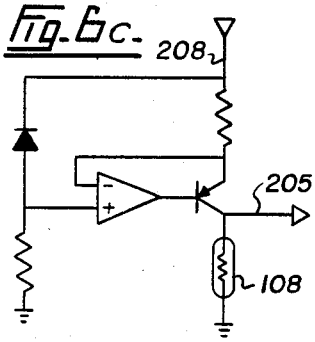
Figure 6D:
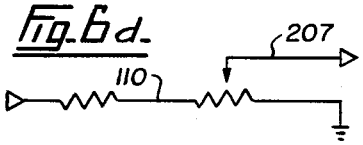
Figure 6E:
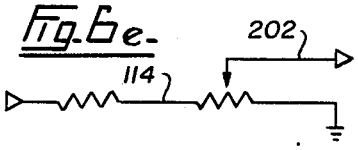
Figure 6F:
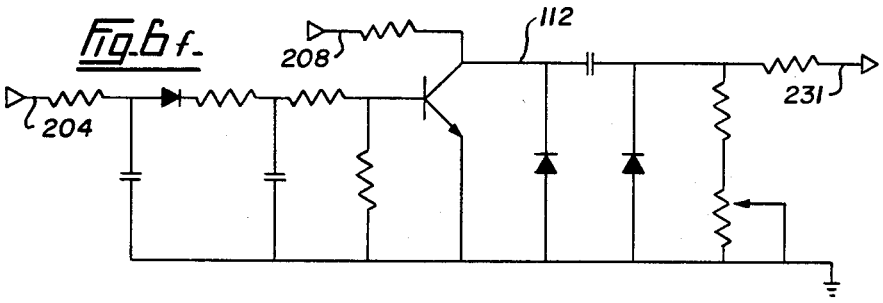
Figure 6G:
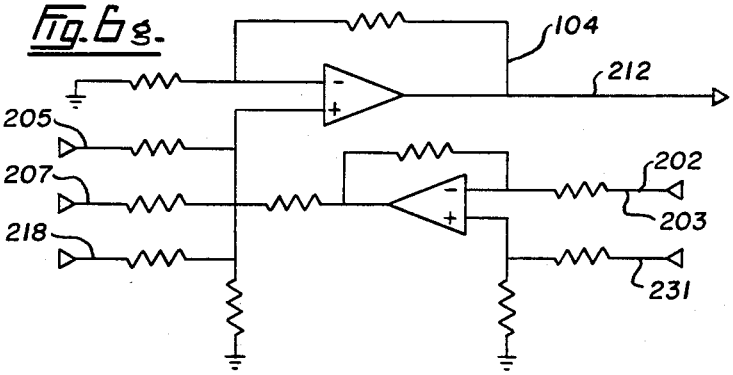

FIGS. 6*a* to 6*g* illustrate the various circuits, which again are entirely conventional. The drawings of the circuits use conventional symbols which will not be discussed further. In FIGS. 6*a* to 6*g*, 6*a* shows the constant voltage supply circuit to generate outward 208 from the input 216 generated by the battery and the generator. FIG. 6*b* illustrates the circuit to sense the cooling system temperature, 106 in FIG. 4, FIG. 6*c* illustrates the intake air temperature circuit, 108 in FIG. 4, 6*d* illustrates the intake air pressure circuit, 110 in FIG. 4. FIG. 6*e* shows the air intake blade opening circuit 114, FIG. 6*f* shows the rpm circuit 112 of FIG. 4 and FIG. 6*g* shows the central control unit circuit, 104 in FIG. 4. The signals generated and fed, as shown in FIG. 5, are also shown in FIGS. 6*a* through 6*g*.

In operating the system according to the present invention the central control unit 104 is an analog computer calculating voltage signals, 205, 207, 218, 202, 203 and 231 received from the circuits illustrated in FIGS. 5 and 6. These signals are the outputs from the various sensing circuits, as described previously. Signal 212 from the central control unit is fed to the amplifier circuit 115. From the signals received the central control unit calculates the load on the vehicle at any one time. The signal 212 generated by the central control unit is sent to the coil in the fuel injector to produce the necessary magnetic effect to move the injector. Thus during the signal changes the magnetic force applied will change. The needle nozzle, with a spring, moves up and down depending on the signal received. The amount of fuel flowing out at any one time changes according to the sectional area displayed by the needle. The spring extension force, the shape of the nozzle needle and its weight have to be carefully calculated. The fuel pressure will also have to remain constant.

To start the engine the conventional startup switch is connected with a cold start relay 120. The fuel sprayed from the injector nozzle is controlled by the central control unit. The nozzle is opened only one or two seconds to avoid flooding. At the same time the fuel pump relay and the air pump are operating. With the engine idling the start relay is off and the contact point on the controls for the blade sensor receives signals 203 and 204. The gas pedal is not depressed so that the plates remain closed. Idling compressed air is fed into nozzle 94 and a small amount of fuel is fed from the injector. The air fuel ratio fits the engine performance, that is idle.

As the engine accelerates the gas pedal is controlled by the driver. The blades open to allow more air to flow in. The central control unit automatically calculates the additional amount of fuel necessary. When the revolutions of the engine exceed, for example, about 1100, depending on the engine, the contact points at the other end of the throttle control receives signals 201, 202 and 203.

As the engine reduces speed the contact point receiving signals 202 and 203 are disconnected and the needle moves downwardly to restrict fuel flow. With an engine speed less than about 1600 rpm the contact points receiving signals 203 and 204 are connected so that idling fuel conditions apply.

When the engine is turned off the air from the blades and the fuel supply system are closed down.

I claim:

1. A carburetor for an internal combustion engine, the carburetor comprising:

an outer body defining a first venturi and having an inlet and an outlet;

a first inner body located in the outer body and defining a second venturi and having an inlet and an outlet;

a second inner body located within the first inner body;

a throttle valve to control air supply to the inlets of the inner and outer bodies;

means within the outer and first and second inner bodies to agitate air flowing through the bodies;

an injector nozzle positioned to feed fuel to the second venturi;

a valve to control fuel supply through the injector nozzle;

sensor means to effect movement of said valve; and an idle jet to feed air to said second venturi downstream of the injector nozzle.

2. A carburetor as claimed in claim 1 in which the throttle valve comprises two relatively rotatable plates, each with open and closed portions that may be rotated to open and close the outer body inlet.

3. A carburetor as claimed in claim 1 in which the means within the inner and outer bodies to agitate air flow within the bodies comprises helically disposed walls attached to the inner faces of the bodies.

4. A carburetor as claimed in claim 1 in which the means to agitate air comprises helically disposed walls within the second inner body.

5. A carburetor as claimed in claim 1 in which the injector nozzle comprises a body having an internal passageway;

an outlet for the internal passageway;

a recess formed in the body communicating with the outlet of the internal passageway.

6. A carburetor as claimed in claim 5 including a solenoid to reciprocate the body relative to the injector nozzle.

7. A carburetor as claimed in claim 6 in which the solenoid is attached to sensor means.

8. A carburetor as claimed in claim 6 in which the sensor means comprises sensors for:

(a) engine cooling temperature;

(b) intake air temperatures;

(c) intake air pressure;

(d) engine revolution; and (e) throttle valve opening;

a control unit to receive signals from each of the above sensors and to send a signal to control movement of the solenoid.

9. A carburetor as claimed in claim 8 including an amplifier to amplify the signal from the control unit to the solenoid.

10. A carburetor for an internal combustion engine, the carburetor comprising:

an outer body defining a first venturi and having an inlet and an outlet;

a first inner body located in the outer body and defining a second venturi and having an inlet and an outlet;

a heating element to heat a vapour leaving said first inner body, said heating element being spring mounted to the first inner body to facilitate mixing and heating of the vapour;

a throttle valve to control air supply to the inlets of the inner and outer bodies;

means within the outer and first inner bodies to agitate air flowing through the bodies;

an injector nozzle positioned to feed fuel to the second venturi;

a valve to control fuel supply through the injector nozzle;

sensor means to effect movement of said valve; and an idle jet to feed air to said second venturi downstream of the injector nozzle.

* * * * *